US007891308B2

(12) United States Patent
Bianchi et al.

(10) Patent No.: US 7,891,308 B2
(45) Date of Patent: Feb. 22, 2011

(54) MARINE VESSEL PANEL ASSEMBLY AND ROLL-FORMED PANEL FOR SAME

(75) Inventors: Tamo P. Bianchi, Oakville (CA); William A. Willsher, Stoney Creek (CA)

(73) Assignee: Samuel, Son & Co., Limited, Mississauga, Ontario (CA)

( * ) Notice: Subject to any disclaimer, the term of this patent is extended or adjusted under 35 U.S.C. 154(b) by 156 days.

(21) Appl. No.: 12/260,301

(22) Filed: Oct. 29, 2008

(65) Prior Publication Data

US 2010/0101478 A1 Apr. 29, 2010

(51) Int. Cl.
*B63B 3/00* (2006.01)

(52) U.S. Cl. ..... 114/79 W; 14/88

(58) Field of Classification Search ..... 114/79 W, 114/88

See application file for complete search history.

(56) References Cited

U.S. PATENT DOCUMENTS 4,457,249 A * 7/1984 Disen ..... 114/88
4,565,146 A * 1/1986 Koser et al. ..... 114/79 R
6,058,865 A * 5/2000 Thibeault ..... 114/79 W
2005/0241152 A1 * 11/2005 McNulty et al. ..... 29/897.2

* cited by examiner

*Primary Examiner*—Stephen Avila
(74) *Attorney, Agent, or Firm*—Hodgson Russ LLP

(57) ABSTRACT

A prefabricated panel assembly for use in constructing a marine vessel comprises a plurality of elongated, roll-formed metal panels fixed sided to side by longitudinal weld seams. The panels include a plate portion and an angle portion adjoining the plate portion along a longitudinal primary bend, the plate portion having a generally flat panel segment, the angle portion having a web generally orthogonal to the panel segment and a flange generally parallel to the panel segment and adjoining the web along a secondary bend. The panel assembly provides a more efficient and cost-effective alternative to using individual structural steel angles welded to individual steel plate in constructing a marine vessel.

24 Claims, 9 Drawing Sheets

MARINE VESSEL PANEL ASSEMBLY AND ROLL-FORMED PANEL FOR SAME

FIELD OF THE INVENTION

The present invention relates to construction technology for building large marine vessels such as ships and barges.

BACKGROUND OF THE INVENTION

Marine vessels, including ships and barges, are used to transport large cargo loads by water routes. By way of example, deck barges are designed to transport cargo situated on the deck of the barge, while tank barges are designed to transport liquid cargo, such as oil, stored in holding tanks inside the barge's hull. Another common type of barge is the bulk or hopper barge, characterized by compartments between the fore and aft bulkheads of the barge for storing bulk materials and items such as rock, coal, sand, soil, steel, grain, and garbage.

Heretofore, barges have been constructed by providing a plurality of transverse truss assemblies spaced at intervals along the longitudinal extent of the barge, and attaching a shell to the respective undersides of the truss assemblies and a deck to the respective topsides of the truss assemblies. Each truss assembly typically includes a lower C-channel member and a parallel upper C-channel member connected by vertical and diagonal truss members. The shell, which may be a plurality of steel plates arranged side-to-side and end-to-end to cover a specified area, is attached to the lower channel member of each truss assembly by way of a series of longitudinally extending angle members spaced at transverse intervals. The deck, like the shell, may be a plurality of steel plates attached in a similar fashion to the upper channel member of each truss assembly by way of a series of longitudinally extending angle members spaced at transverse intervals. A second (inner) shell may be provided by arranging steel plates between the lower channel members of the truss assemblies and the longitudinal angle members to which the first (outer) shell is fixed.

FIGS. 1A and 1B illustrate a common construction of a single shelled barge in accordance with prior art technology. The longitudinal axis of the barge runs into and out of the drawing page. A transverse truss assembly 10 includes a lower C-channel member 12 and an upper C-channel member 14 connected by vertical truss members 16 and diagonal truss members 18. The truss members 16, 18 may be lengths of structural steel angle on channel welded at their respective end regions to the outer web surfaces of channel members 12, 14. Longitudinal angle members 22 may be spaced at transverse intervals, as shown in FIG. 1A. The flange of each angle member 22 may be welded to a bottom flange of lower channel member 12, and the web of each angle member 22 may be welded to an adjacent plate forming part of an outer shell 24.

Further longitudinal angle members 26 may have their respective flanges welded to upper channel member 14 and their respective webs welded to plates forming a deck 28.

As may be understood, prior art construction as described above utilizes structural steel members having standard cross-sectional configurations in conjunction with steel plate. While this may simplify purchasing of structural steel angle, channel and plate, it complicates fabrication and assembly. For example, multiple longitudinal weld seams are needed to fix the web of longitudinal angle members 22, 26 to an adjacent plate of the outer shell 24 or deck 28, as the case may be. The angle members 22, 26 must be properly positioned with respect to the plate prior to welding, which requires additional man-hours and fixtures for set-up.

SUMMARY OF THE INVENTION

The present invention provides a panel assembly for use in constructing a marine vessel, a method of making such a panel assembly, and a panel for use as a constituent part of such a panel assembly.

A panel assembly formed in accordance with the present invention generally comprises a plurality of elongated metal panels, each panel being roll-formed from a single strip of material to include a plate portion and an angle portion adjoining the plate portion along a longitudinal primary bend, the plate portion having a generally flat panel segment, the angle portion having a web generally orthogonal to the panel segment and a flange generally parallel to the panel segment and adjoining the web along a secondary bend. In the panel assembly, a first panel of the plurality of panels is fixed to a second panel of the plurality of panels by a longitudinal weld seam joining the plate portion of the first panel to the primary bend of the second panel.

The panel assembly may be a side shell panel assembly having a plurality of panels as summarized above bounded by a roll-formed gunwale panel and a roll-formed bilge radius panel. The bilge radius panel may be replaced by a flat plate panel and a rake cut may be provided at one end of the panel assembly to fabricate a side shell panel assembly suitable for use at a raked end of a barge.

The method of manufacturing a panel assembly for use in constructing a marine vessel generally comprises the steps of roll-forming a plurality of elongated flat metal strips to make a plurality of elongated metal panels, wherein the roll-forming operation includes forming a longitudinal primary bend to distinguish a plate portion of the panel from an angle portion of the panel, and forming a longitudinal secondary bend to distinguish a flange of the angle portion from a web of the angle portion, the flange extending in an opposite direction from the web than the plate portion; arranging the plurality of panels side-by-side such that the plate portion of one panel engages at least one of the primary bend and the web of a sidewise adjacent panel; and, for each pair of sidewise adjacent panels, welding the plate portion of the one panel to the primary bend of the adjacent panel to form a respective longitudinal weld seam joining such pair of sidewise adjacent panels.

A panel formed in accordance with the present invention generally comprises an elongated metal panel roll-formed from a single strip of material to include a plate portion and an angle portion adjoining the plate portion along a longitudinal primary bend, the plate portion having a generally flat panel segment, the angle portion having a web generally orthogonal to the panel segment and a flange generally parallel to the panel segment and adjoining the web along a secondary bend. The plate portion includes a side region extending parallel to the primary bend and arranged to engage at least one of the primary bend and the web of an identical panel sidewise adjacent thereto.

BRIEF DESCRIPTION OF THE DRAWING FIGURES

The nature and mode of operation of the present invention will now be more fully described in the following detailed description of the invention taken with the accompanying drawing figures, in which.

DETAILED DESCRIPTION OF THE INVENTION

Figure 1A:
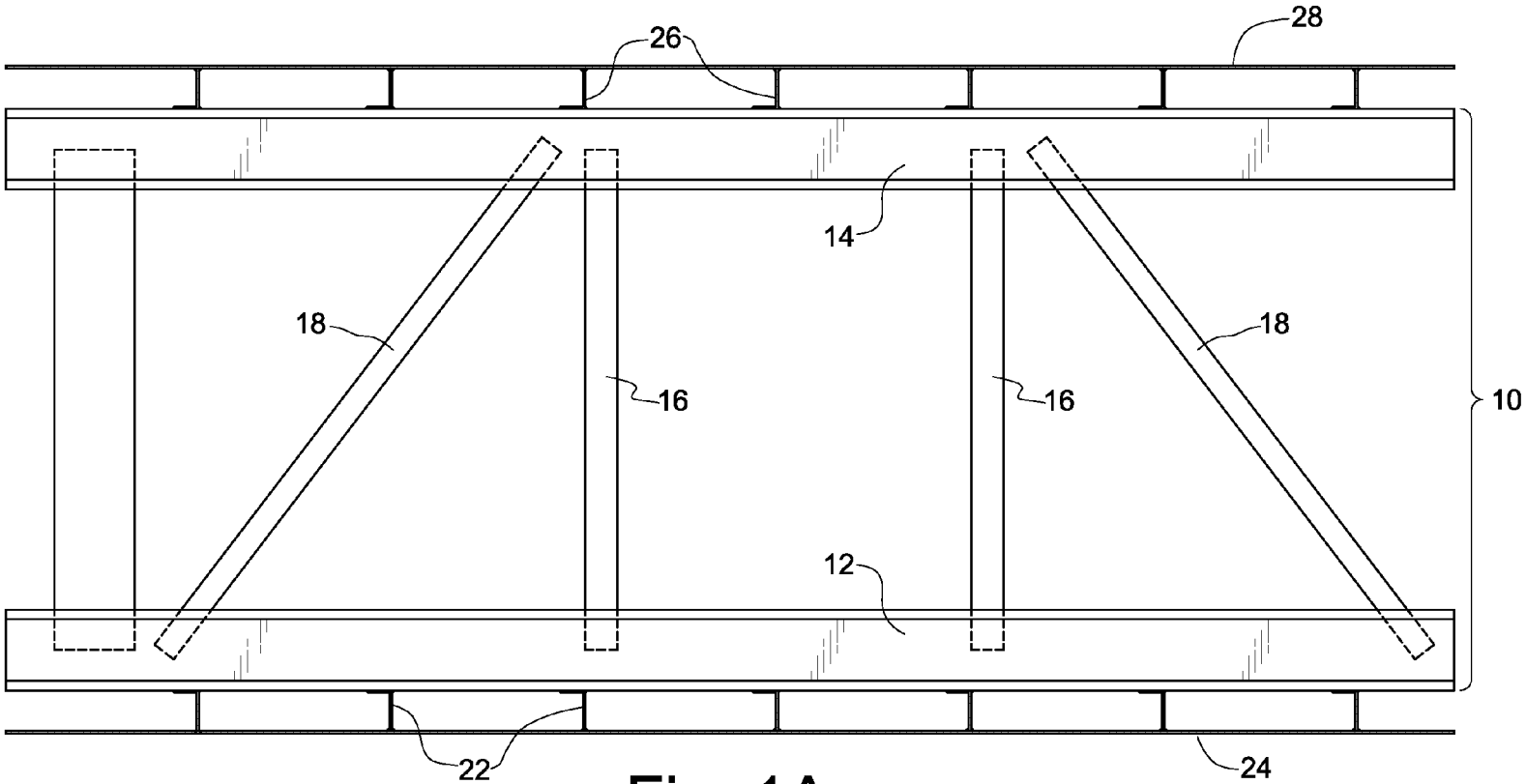
Fig. 1A PRIOR ART
FIG. 1A is a cross-sectional view of a deck barge formed in accordance with the prior art.
Figure 1B:
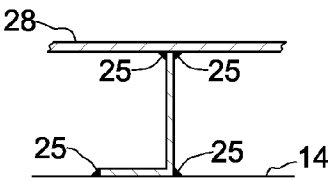
Fig. 1B PRIOR ART
FIG. 1B is a cross-sectional detail of the prior art deck barge shown in FIG. 1A.
Figure 2:
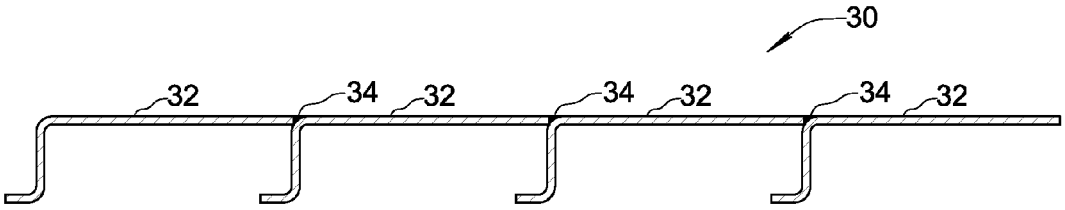
FIG. 2 is a cross-sectional view of a panel assembly for use in building a marine vessel, wherein the panel assembly and its constituent panels are formed in accordance with a first embodiment of the present invention.
Figure 3:
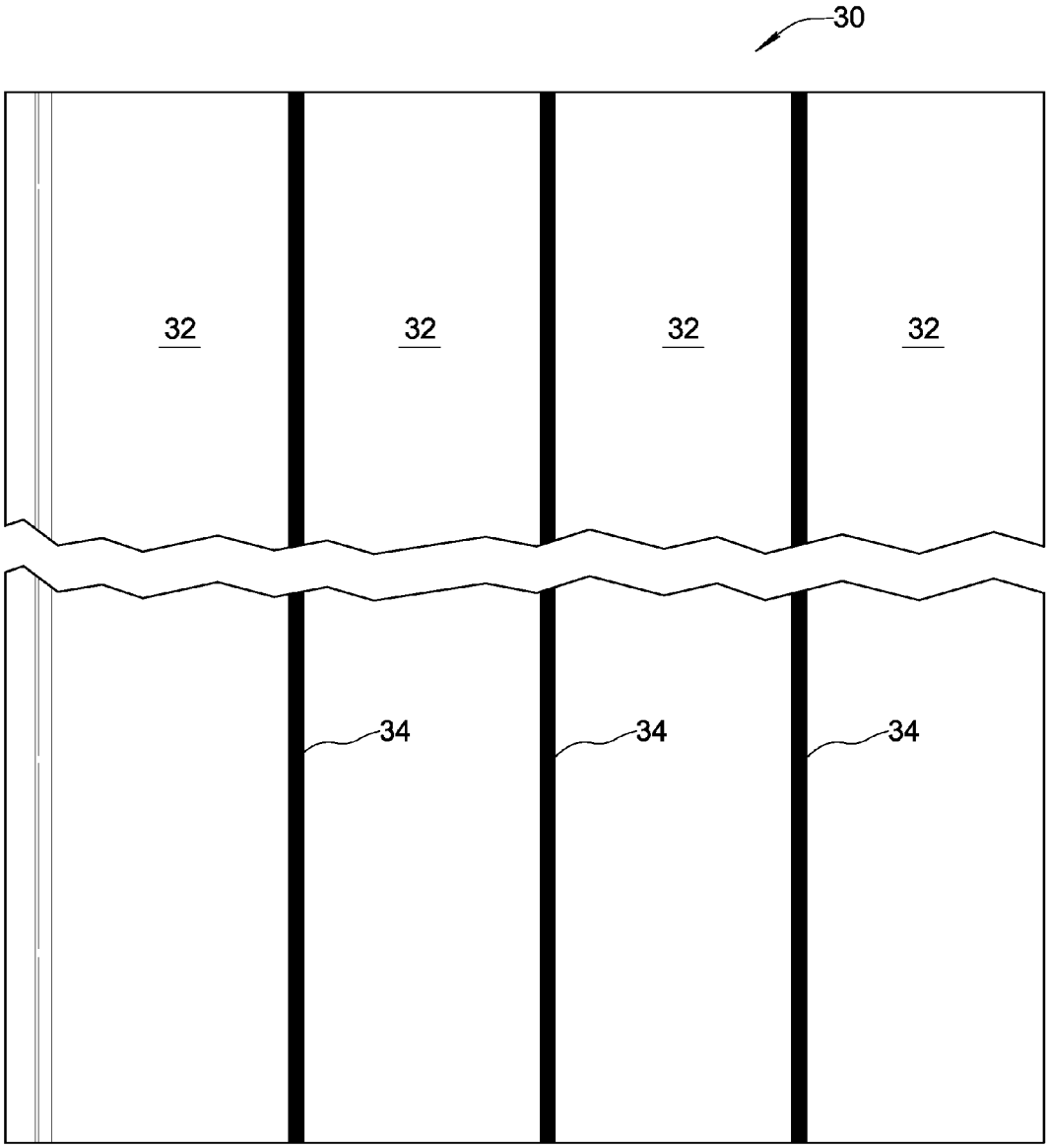
FIG. 3 is a top plan view of the panel assembly shown in FIG. 2.

Reference is made initially to FIGS. 2 and 3, which show a panel assembly 30 for use in constructing a marine vessel. Panel assembly 30 may be combined with other panel assemblies of similar construction, and is intended to replace longitudinal angle members and plate found in prior art constructions, such as angle members 22 and plates 24 and/or angle members 26 and plates 28 illustrated in FIG. 1A.

Panel assembly 30 generally comprises a plurality of elongated metal panels 32 arranged side-by-side and fixed to one another by a series of longitudinal weld seams 34.

Figure 4:
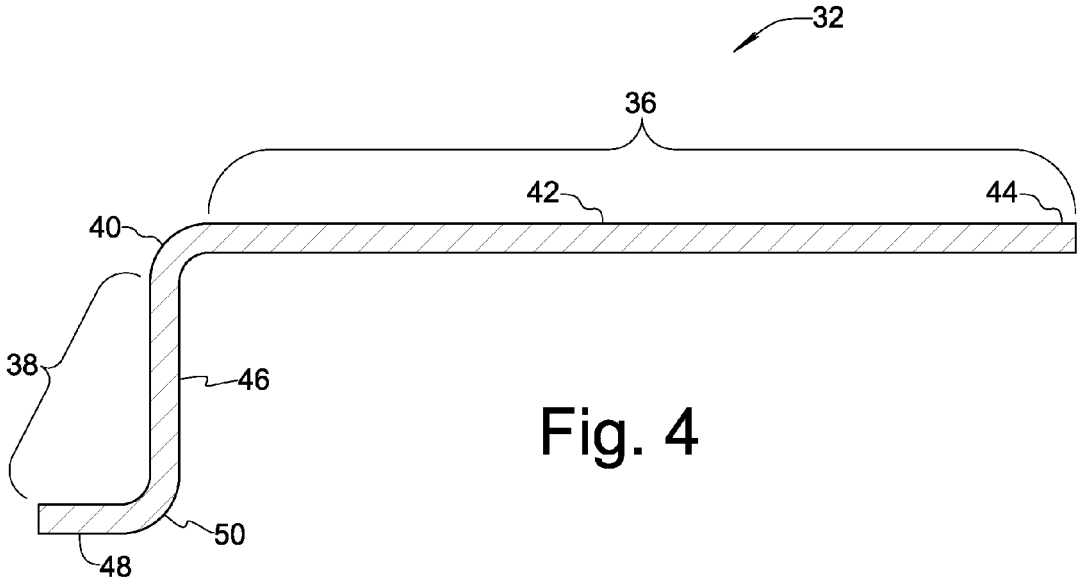
FIG. 4 is a cross-sectional view of a single roll-formed panel of the first embodiment.

FIG. 4 shows a cross-sectional configuration of an individual panel 32 in detail. Panel 32 may be roll-formed from a single strip of material of suitable dimensions. For example, strips of steel plate of suitable thickness and width may be roll-formed to impart a predetermined cross-sectional configuration and cut to a desired length. A conventional roll-forming machine of a type having a series of stations with rollers set up to progressively form bends in the strip may be used to cold form the steel strips to manufacture panels 32. In prototypical designs, the steel strips range in thickness from 0.250 inches (0.635 cm) to 0.625 inches (1.5875 cm), however thicknesses outside this range may be used. Other dimensions of panel 32 are also subject to design choice. Roll-formed panel lengths up to about 120 feet (36.6 meters) are possible using currently-installed material handling equipment, however longer panel lengths are possible with suitable material handling equipment, and panel length is not limited by roll-forming technology.

In the first embodiment shown in FIG. 4, panel 32 includes a plate portion 36 and an angle portion 38 adjoining plate portion 36 along a longitudinal primary bend 40 extending the length of panel 32. Plate portion 36 is characterized by a flat panel segment 42 and a side region 44. Angle portion 38 has a web 46 generally orthogonal to panel segment 42, and a flange 48 generally parallel to panel segment 42 and adjoining web 46 along a longitudinal secondary bend 50 extending the length of panel 32. By way of non-limiting example, and merely to provide dimensional order-of-magnitude, flange 48 may be about 3 inches (7.62 cm) in length, web 46 may be from about 3 inches (7.62 cm) in length to about 6 inches (15.24 cm) in length, and plate portion 36 may be from about 14 inches (35.56 cm) to about 24 inches (60.96 cm) in length. Again, dimensions other than those given as examples may also be used.

Panels 32 may be roll-formed from ASTM A36 alloy steel. American Bureau of Shipping (ABS) steel grades A, B, AH, and DH are considered suitable for practicing the present invention.

As best seen in FIG. 2, the plate portion 36 of a first panel 32 is joined by a respective weld seam 34 to the primary bend 40 of a second panel 32 adjacent to the first panel. More particularly, side region 44 of the first panel runs parallel to primary bend 40 of the second panel and engages the primary bend when the panels are sidewise adjacent, and weld seam 34 fills the slight longitudinal channel that exists between the panels due to the curvature of primary bend 40.

The type of weld seam 34 will depend upon the material used for panels 32 and environmental considerations associated with marine vessels, including corrosion resistance requirements. Weld seams 34 may be provided according to ABS standards using a submerged arc welding process.

As may be understood, the flat panel segments 42 of panels 32 and weld seams 34 cooperate to form a generally flat deck or skin surface for the marine vessel. In this regard, it may be desirable to grind the weld seams 34 to be flush with panel segments 42. Surface texturing may be applied to panel segments 42.

While panel assembly 30 shown in FIGS. 2 and 3 has four panels, a panel assembly of the present invention may have a different number of panels, but always at least two panels. An advantage of the present invention is that panel assemblies 30 may be prefabricated at a remote manufacturing facility, and then transported to a shipyard for use in constructing a marine vessel. The dimensions of a given panel assembly 30 can be selected to suit vessel design requirements, for example by adjusting the length and width of constituent panels 32, and the total number of panels 32 in the panel assembly 30.

Figure 5:
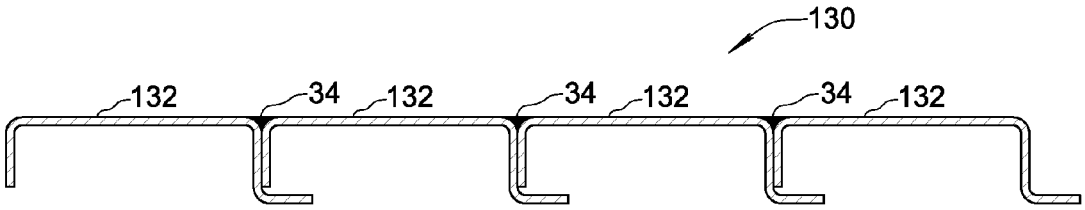
FIG. 5 is a cross-sectional view of a panel assembly for use in building a marine vessel, wherein the panel assembly and its constituent panels are formed in accordance with a second embodiment of the present invention.
Figure 6:
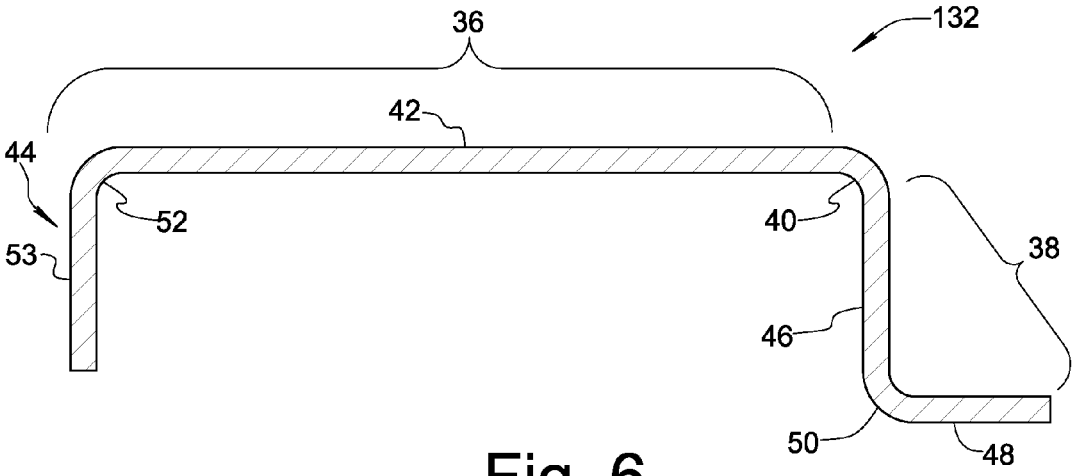
FIG. 6 is a cross-sectional view of a single roll-formed panel of the second embodiment.

FIGS. 5 and 6 illustrate a second embodiment of the present invention. FIG. 5 shows a panel assembly 130 comprising a plurality of elongated metal panels 132 arranged side-by-side and fixed to one another by a series of longitudinal weld seams 34. As may be seen in FIG. 6, the cross-sectional configuration of panels 132 is generally similar to the cross-sectional configuration of panels 32. More specifically, panels 132 are roll-formed to include a plate portion 36 and an angle portion 38 adjoining plate portion 36 along a longitudinal primary bend 40 extending the length of panel 132. Plate portion 36 is characterized by a flat panel segment 42 and a side region 44. Angle portion 38 has a web 46 generally orthogonal to panel segment 42, and a flange 48 generally parallel to panel segment 42 and adjoining web 46 along a longitudinal secondary bend 50 extending the length of panel 32.

Panel 132 differs from panel 32 in the configuration of side region 44. In panel 132, side region 44 adjoins panel segment 42 along a tertiary bend 52 and has a surface 53 generally orthogonal to panel segment 42. Accordingly, surface 53 may be arranged in flush engagement with an opposing surface of web 46 of a sidewise adjacent panel in panel assembly 130.

Figure 7:
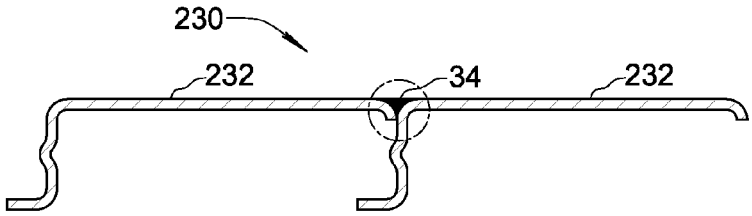
FIG. 7 is a cross-sectional view of a panel assembly for use in building a marine vessel, wherein the panel assembly and its constituent panels are formed in accordance with a third embodiment of the present invention.
Figure 8:
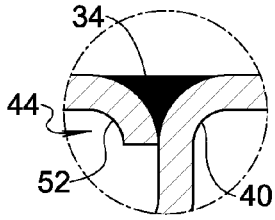
FIG. 8 is an enlarged view of the circled area in FIG. 7, showing a weld seam joining adjacent panels of the panel assembly.
Figure 9:
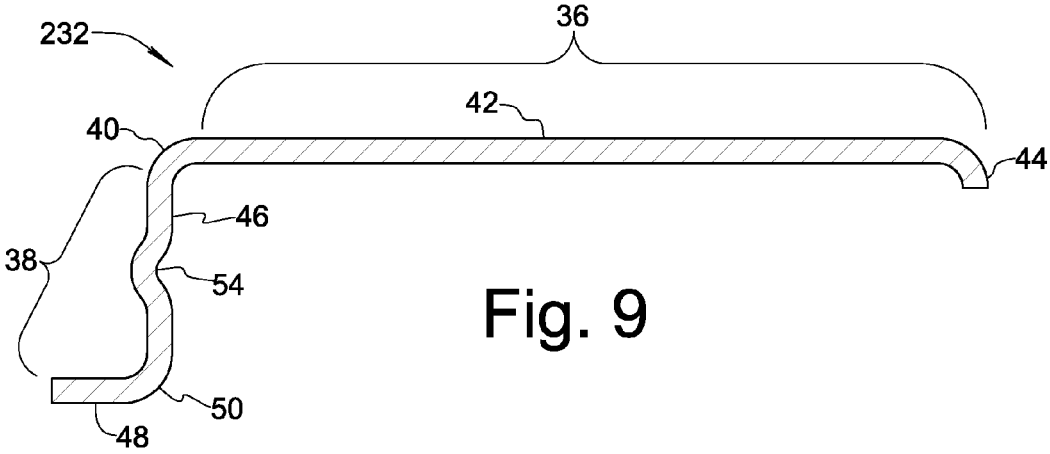
FIG. 9 is a cross-sectional view of a single roll-formed panel of the third embodiment.

Attention is now directed to FIGS. 7-9 which illustrate a third embodiment of the present invention. FIG. 7 shows a panel assembly 230 comprising a plurality of elongated metal panels 232 arranged side-by-side and fixed to one another by a series of longitudinal weld seams 34. As may be seen in FIG. 9, the cross-sectional configuration of panels 232 is generally similar to the cross-sectional configuration of panels 32 from the standpoint that panels 232 are roll-formed to include a plate portion 36 and an angle portion 38 adjoining plate portion 36 along a longitudinal primary bend 40 extending the length of panel 232. As with panels 32, plate portion 36 of panel 232 is characterized by a flat panel segment 42 and a side region 44. Angle portion 38 of panel 232 has a web 46 generally orthogonal to panel segment 42, and a flange 48 generally parallel to panel segment 42 and adjoining web 46 along a longitudinal secondary bend 50 extending the length of panel 232.

Panel 232 has a differently configured side region 44 in comparison to panel 32. Side region 44 of panel 232 consists of a tertiary bend 52 alone, without a downward extension providing an engagement surface 53, as in the previous embodiment. Panel 232 is further notable for an undulation 54 formed in web 46.

Figure 10:
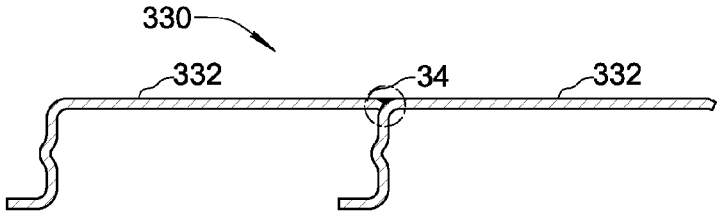
FIG. 10 is a cross-sectional view of a panel assembly for use in building a marine vessel, wherein the panel assembly and its constituent panels are formed in accordance with a fourth embodiment of the present invention.
Figure 11:
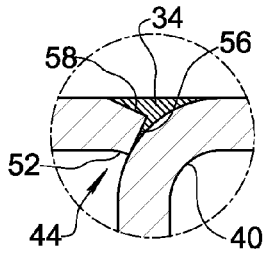
FIG. 11 is an enlarged view of the circled area in FIG. 10, showing a weld seam joining adjacent panels of the panel assembly.
Figure 12:
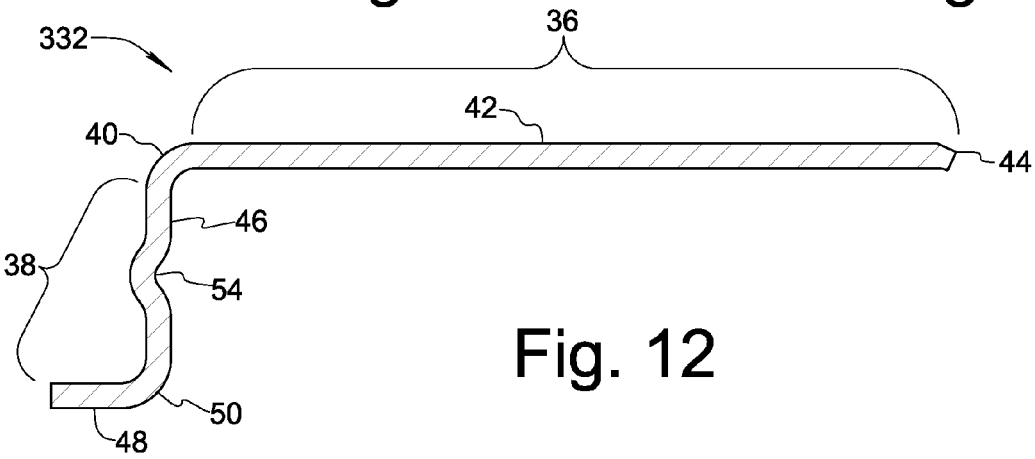
FIG. 12 is a cross-sectional view of a single roll-formed panel of the fourth embodiment.

FIGS. 10-12 show a fourth embodiment of the present invention. A panel assembly 330 of the fourth embodiment comprises a plurality of elongated, roll-formed metal panels 332 joined to one another in side-by-side arrangement by a series of longitudinal weld seams 34. The cross-sectional configuration of panels 332 includes a plate portion 36 characterized by a flat panel segment 42 and a side region 44, and an angle portion 38 adjoining plate portion 36 along a longitudinal primary bend 40 extending the length of panel 332. As with the other embodiments described herein, angle portion 38 of panel 332 has a web 46 generally orthogonal to panel segment 42, and a flange 48 generally parallel to panel segment 42 and adjoining web 46 along a longitudinal secondary bend 50 extending the length of panel 332. Web 46 is depicted as including an undulation 54.

As best seen in FIG. 11, the configuration of panels 332 is characterized by a very slight tertiary bend 52 along plate portion 36 which directs a side surface 56 against the outer curved surface of the primary bend 40 of an adjacent panel 332. The side region 44 of panel 332 includes an inclined surface 58 sloped relative to the panel segment 42. Inclined surface 58 may be formed by providing machining station(s) in the roll-forming machine to mill the flat surface 58, or panels 332 may be machined separately from roll-forming.

Figure 13:
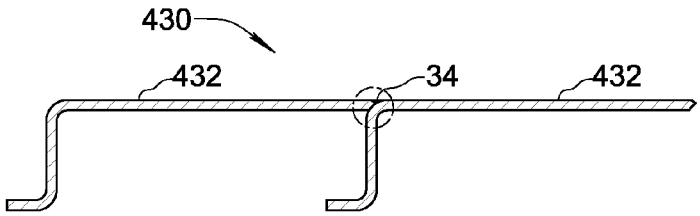
FIG. 13 is a cross-sectional view of a panel assembly for use in building a marine vessel, wherein the panel assembly and its constituent panels are formed in accordance with a fifth embodiment of the present invention.
Figure 14:
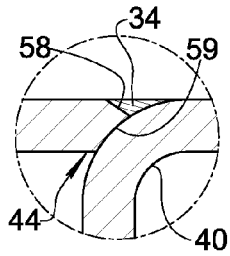
FIG. 14 is an enlarged view of the circled area in FIG. 13, showing a weld seam joining adjacent panels of the panel assembly.
Figure 15:
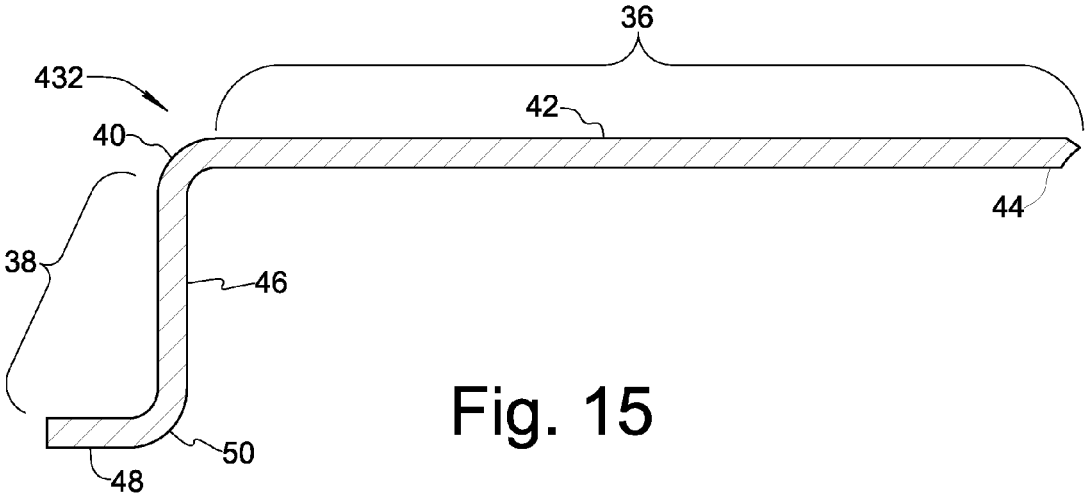
FIG. 15 is a cross-sectional view of a single roll-formed panel of the fifth embodiment.

A fifth embodiment of the present invention is shown in FIGS. 13-15. A panel assembly 430 comprises a plurality of elongated, roll-formed metal panels 432 joined to one another by a series of longitudinal weld seams 34. The cross-sectional configuration of panels 432 includes a plate portion 36 having a flat panel segment 42 and a side region 44, and an angle portion 38 adjoining plate portion 36 along a longitudinal primary bend 40 extending the length of panel 432. Similar to the other embodiments described herein, angle portion 38 of panel 432 has a web 46 generally orthogonal to panel segment 42, and a flange 48 generally parallel to panel segment 42 and adjoining web 46 along a longitudinal secondary bend 50 extending the length of panel 432.

As illustrated in FIG. 14, the side region 44 of panel 432 includes an inclined surface 58 sloped relative to the panel segment 42, and a contoured side surface 59 having a radius of curvature matching that of the outer curved surface of primary bend 40 of an adjacent panel 432. Contoured side surface 59 is concave and engages the convex surface of neighboring primary bend 40 in flush surface-to-surface engagement. Inclined surface 58 cooperates with the primary bend of the adjacent panel to form a longitudinal channel for receiving weld material. Inclined surface 58 and contoured surface 59 may be formed by providing machining station(s) in the roll-forming machine to mill the surfaces, or panels 432 may be machined separately from roll-forming.

Figure 16:
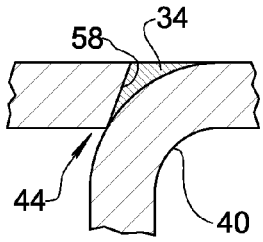
FIG. 16 is an enlarged view similar to that of FIG. 14, showing an alternative embodiment wherein the side region of the panel has a beveled surface therealong.
Figure 17:
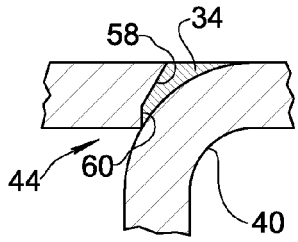
FIG. 17 is an enlarged view similar to that of FIG. 16, showing an alternative embodiment wherein the side region of the panel has an offset beveled surface therealong.

FIGS. 16 and 17 show alternative configurations of side region 44. As in FIGS. 13-15, the configuration of side region 44 may be formed by machining the side region and without providing a tertiary bend. In FIG. 16, inclined surface 58 is formed by machining a bevel along the edge of side region 44 such that the inclined surface 58 created by the bevel forms an acute angle with an imaginary tangent plane tangent to the outer curved surface of primary bend 40. As shown in FIG. 17, the bevel may be offset vertically from the underside of the panel to provide an inclined surface 58 that meets with a vertical surface 60.

Figure 18:
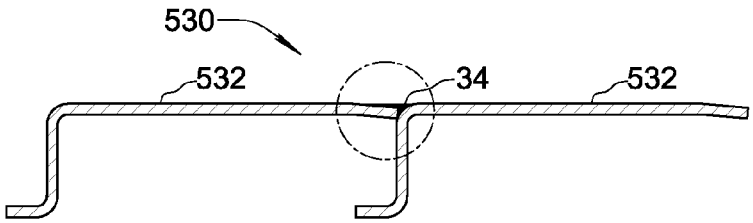
FIG. 18 is a cross-sectional view of a panel assembly for use in building a marine vessel, wherein the panel assembly and its constituent panels are formed in accordance with a sixth embodiment of the present invention.
Figure 19:
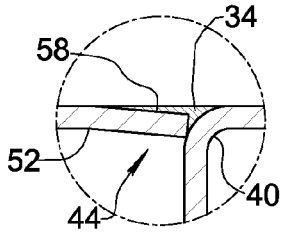
FIG. 19 is an enlarged view of the circled area in FIG. 18, showing a weld seam joining adjacent panels of the panel assembly.
Figure 20:
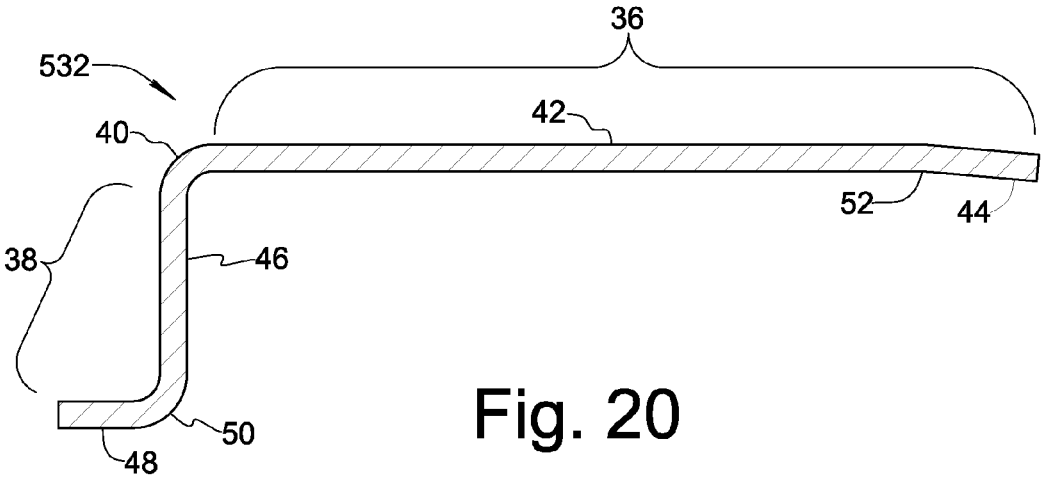
FIG. 20 is a cross-sectional view of a single roll-formed panel of the sixth embodiment.
Figure 22:
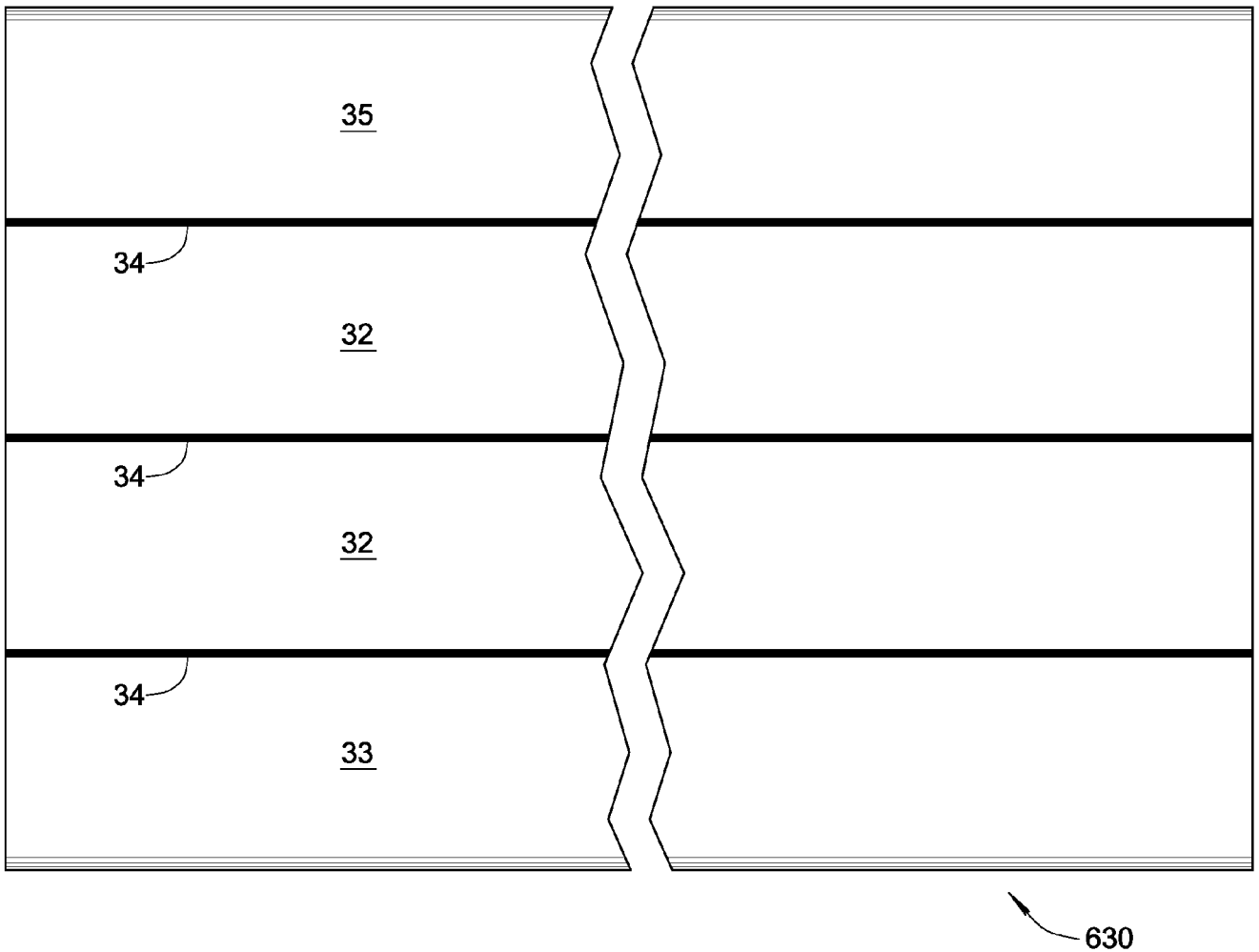
FIG. 22 is a side elevational view of the side shell panel assembly shown in FIG. 21.
Figure 21:
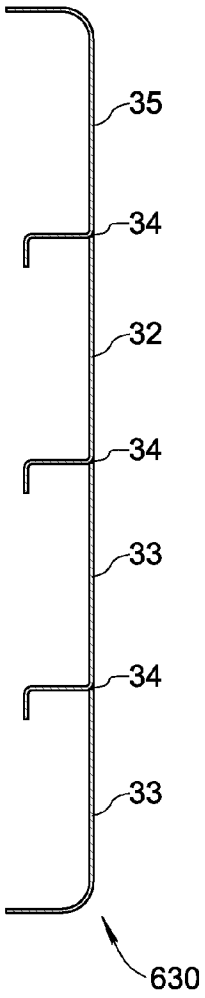
FIG. 21 is a cross-sectional view of a side shell panel assembly for use in building a marine vessel, wherein the panel assembly and its constituent panels are formed in accordance with a seventh embodiment of the present invention.
Figure 23:
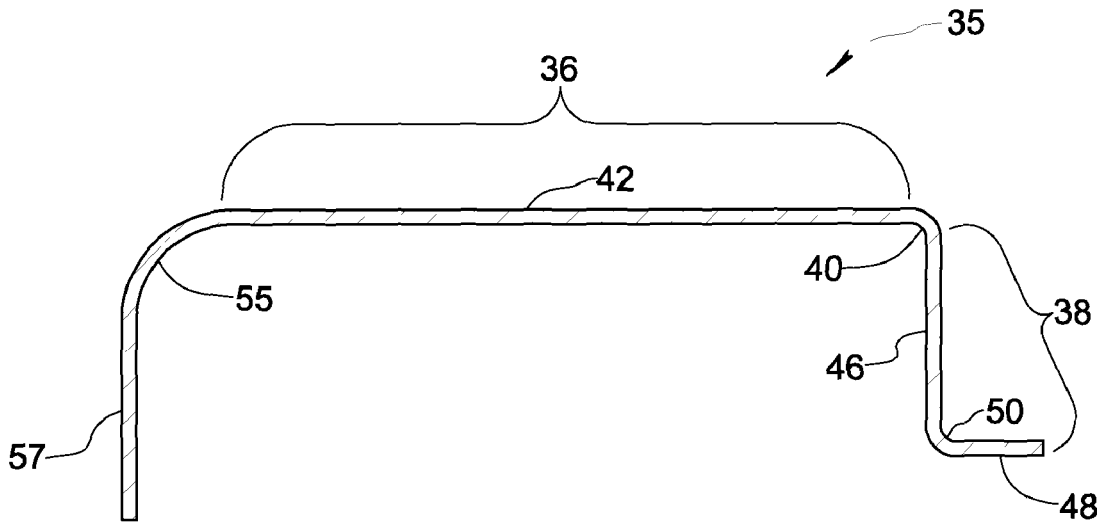
FIG. 23 is a cross-sectional view of a roll-formed deck gunwale panel of the seventh embodiment.
Figure 24:
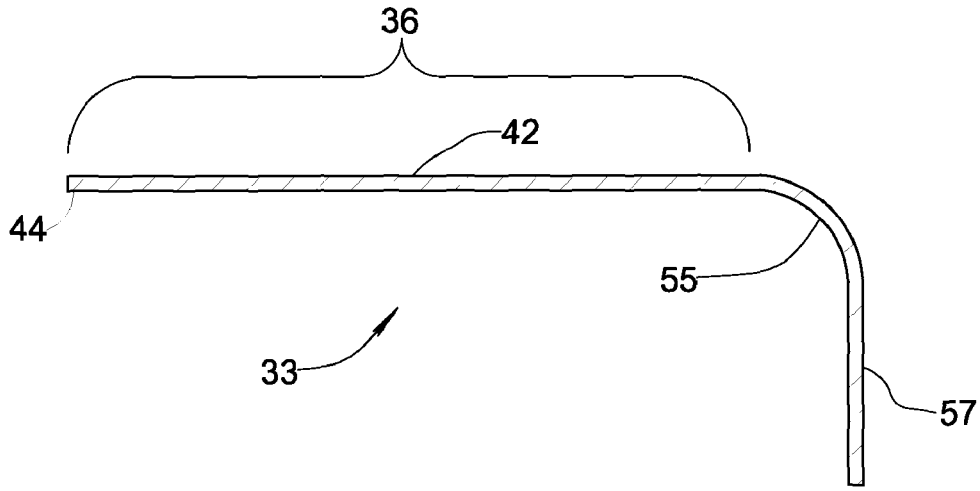
FIG. 24 is a cross-sectional view of a roll-formed bilge radius panel of the seventh embodiment.

Turning now to FIGS. 18-20, a sixth embodiment of the present invention is shown. FIG. 18 shows a panel assembly 530 comprising a plurality of elongated metal panels 532 arranged side-by-side and fixed to one another by a series of longitudinal weld seams 34. As may be seen in FIG. 20, the cross-sectional configuration of panels 532 is generally similar to the cross-sectional configuration of panels in the earlier embodiments. Panels 532 are roll-formed to include a plate portion 36 and an angle portion 38 adjoining plate portion 36 along a longitudinal primary bend 40 extending the length of panel 532. Plate portion 36 of panel 532 includes a flat panel segment 42 and a side region 44. Angle portion 38 of panel 232 has a web 46 generally orthogonal to panel segment 42, and a flange 48 generally parallel to panel segment 42 and adjoining web 46 along a longitudinal secondary bend 50 extending the length of panel 232.

As may be seen in FIG. 19, plate portion 36 of panel 532 further includes a roll-formed tertiary bend 52 along its length, and side region 44 adjoins panel segment 42 along the tertiary bend. As a result, side region 44 includes an inclined surface 58 sloped relative to panel segment 42.

FIGS. 21-24 illustrate a side shell panel assembly 630 and constituent roll-formed panels 32, 33, 35 thereof in accordance with a seventh embodiment of the present invention. The side shell panel assembly 630 may be fabricated using a pair of panels 32 in between a deck gunwale panel 35 and a bilge radius panel 33. The panels are joined by longitudinal weld seams 34. Deck gunwale panel 35, shown in detail in FIG. 23, includes a plate portion 36 and an angle portion 38 adjoining plate portion 36 along a longitudinal primary bend 40 extending the length of panel 35. Plate portion 36 has a flat panel segment 42. Angle portion 38 has a web 46 generally orthogonal to panel segment 42, and a flange 48 generally parallel to panel segment 42 and adjoining web 46 along a longitudinal secondary bend 50 extending the length of panel 35. Gunwale panel 35 further includes a large radius tertiary bend 55 defining rail portion 57. Bilge radius panel 33, shown in FIG. 24, includes a plate portion 36 having a panel segment 42 and a side region 44. Bilge radius panel 33 also includes a rail portion 57 joined to plate portion 36 by a large radius bend 55 running the length of bilge radius panel 33. In the embodiment shown, rail portions 57 are the same length, and the rail portion 57 of gunwale panel 35 is slightly longer than web 46. By way of non-limiting example, and merely to provide a dimensional order of magnitude, the radius of curvature of large radius bends 55 may be 2.5 inches (6.35 cm).

Figure 25:
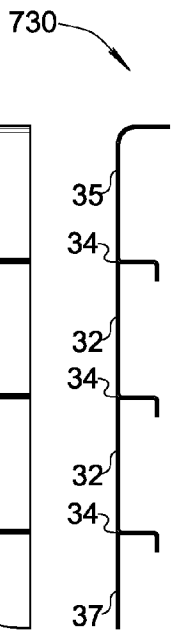
FIG. 25 is a cross-sectional view of a side shell panel assembly similar to that of FIG. 21, but intended for use at a raked end of a barge.
Figure 26:
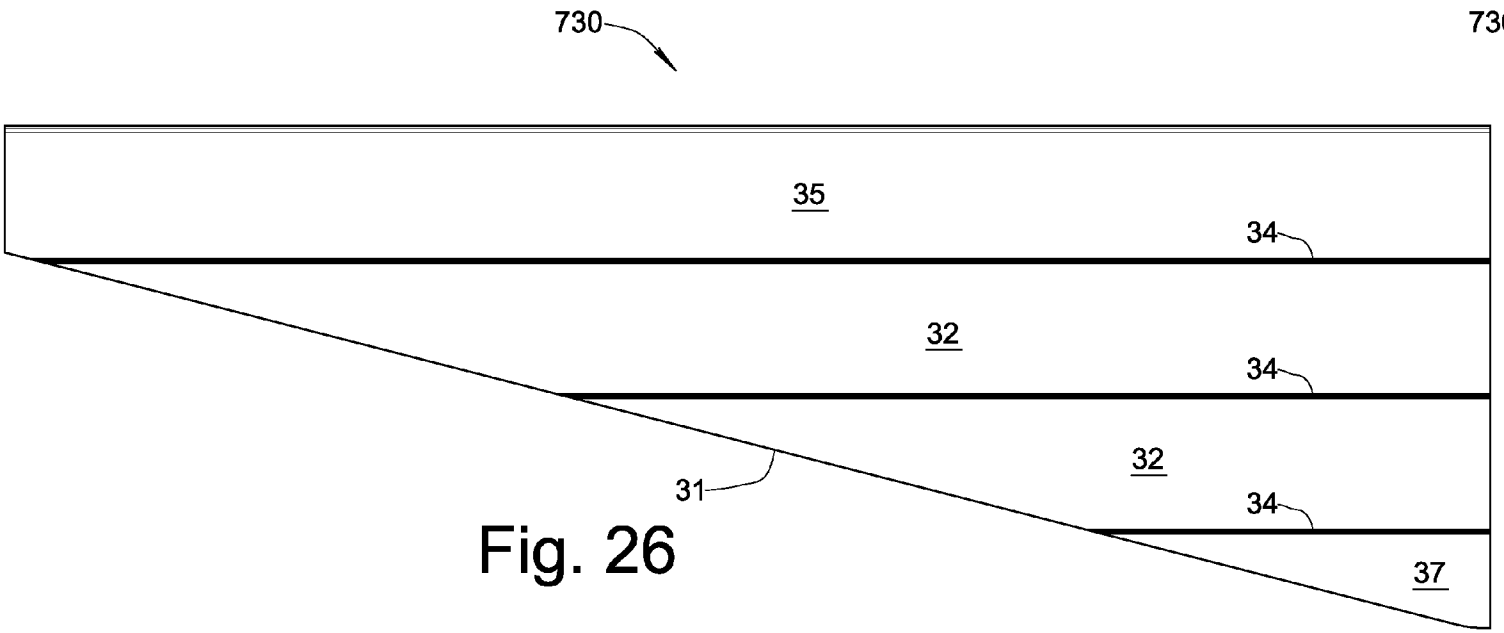
FIG. 26 is a side elevational view of the side shell panel assembly shown in FIG. 25.

FIGS. 25 and 26 illustrate a modified side shell panel assembly 730 for use at a raked end of a barge. Side shell panel assembly 730 is generally similar to side shell panel assembly 630 of FIGS. 21 and 22, however the bilge radius panel 33 is replaced by a flat plate panel 37, and a rake angle 31 is cut at one end of panels 32, 35 and 37.

The present invention further encompasses a method of manufacturing a panel assembly for use in constructing a marine vessel. The method comprises the step of roll-forming a plurality of elongated flat metal strips to make a plurality of elongated metal panels, wherein the roll-forming operation includes forming a longitudinal primary bend 40 to distinguish a plate portion 36 of the panel from an angle portion 38 of the panel, and forming a longitudinal secondary bend 50 to distinguish a flange 48 of the angle portion 38 from a web 46 of the angle portion 38, the flange 48 extending in an opposite direction from the web 46 than the plate portion 36. The method further comprises the step of arranging the plurality of panels side-by-side such that the plate portion 36 of one panel engages at least one of the primary bend 40 and the web 46 of a sidewise adjacent panel. For each pair of sidewise adjacent panels provided in the immediately preceding step, the method comprises the additional step of welding the plate portion 36 of the one panel to the primary bend 40 of the adjacent panel to form a respective longitudinal weld seam 34 joining such pair of sidewise adjacent panels.

The roll-forming operation of the method described above may include forming a longitudinal tertiary bend 52 primary bend along the plate portion 36 of at least one of the plurality of panels. The method may also include machining a side region 44 of at least one of the plurality of panels to provide a concave curved surface 59 along the side region, or to provide an inclined surface 58 sloped relative to a panel segment 42 of the plate portion 36, or to provide both the curved surface 59 and the inclined surface 58.

To provide a side shell panel assembly, the method may also include the steps of roll-forming a gunwale panel 35 and a bilge radius panel 33, and welding each of the panels 35 and 33 to a respective adjacent intermediate panel 32. To provide a side shell panel assembly for use at a raked end of a barge, the steps mentioned immediately above may be modified by using a flat plate panel in place of roll-formed bilge radius panel 33, and cutting a rake angle 31 in the panel assembly or in the constituent panels thereof prior to welding.

As may be understood from the foregoing description, the present invention enables a prefabrication of panel assemblies at a location remote from the shipyard where a marine vessel is being built. The panel assemblies may be supplied as needed and assembled to one another as part of the vessel construction process. The long panel assemblies provide increased coverage as the barge is assembled. As a consequence, vessel manufacturing time and material costs are significantly reduced over prior art construction methods.

Another advantage of the present invention is that the sectional strength associated with each panel may be adjusted by changing the locations of the bends 40, 50, 52, and 55, without the need to order different structural steel cross-sections as is necessary in the prior art.

While the present invention has been shown and described, and several embodiments thereof discussed, persons skilled in this art will readily appreciate that various changes and modifications may be made, without departing from the spirit of the invention, as defined by the following claims.

What is claimed is:

1. An assembly for use in constructing a marine vessel, the assembly comprising:

a plurality of elongated metal panels, each panel being roll-formed from a single strip of material having a predetermined thickness, the strip being roll-formed to include a plate portion and an angle portion adjoining the plate portion along a longitudinal primary bend, the plate portion having a generally flat panel segment, the angle portion having a web generally orthogonal to the panel segment and a flange generally parallel to the panel segment and adjoining the web along a secondary bend;

wherein a first panel of the plurality of panels is fixed to a second panel of the plurality of panels by a longitudinal weld seam joining the plate portion of the first panel to a convex surface of the primary bend of the second panel.

2. The assembly according to claim 1, wherein the weld seam joins the flat panel segment of the plate portion of the first panel to the primary bend of the second panel.

3. The assembly according to claim 1, wherein each panel is roll-formed to further include a longitudinal tertiary bend along the plate portion.

4. The assembly according to claim 3, wherein the plate portion has a side region consisting of the tertiary bend.

5. The assembly according to claim 3, wherein the plate portion has a side region adjoining the panel segment of the plate portion along the tertiary bend.

6. The assembly according to claim 5, wherein the side region includes an inclined surface sloped relative to the panel segment.

7. The assembly according to claim 5, wherein the side region includes a surface generally orthogonal to the panel segment.

8. The assembly according to claim 1, wherein the plate portion of the first panel has a side region including a contoured side surface that engages the primary bend of the second panel in flush surface-to-surface engagement.

9. The assembly according to claim 8, wherein the side region of the first panel further includes a non-engaged surface cooperating with the primary bend of the second panel to form a longitudinal channel for receiving weld material.

10. An assembly for use in constructing a marine vessel, the assembly comprising:

a plurality of elongated metal panels, each panel being roll-formed from a single strip of material to include a plate portion and an angle portion adjoining the plate portion along a longitudinal primary bend, the plate portion having a generally flat panel segment, the angle portion having a web generally orthogonal to the panel segment and a flange generally parallel to the panel segment and adjoining the web along a secondary bend;

wherein a first panel of the plurality of panels is fixed to a second panel of the plurality of panels by a longitudinal weld seam joining the plate portion of the first panel to the primary bend of the second panel; and an elongated gunwale panel roll-formed from a single strip of material, the gunwale panel being roll-formed to include a plate portion, an angle portion adjoining the plate portion along a longitudinal primary bend, and a rail portion adjoining the plate portion along a longitudinal tertiary bend, the plate portion having a generally flat panel segment, the angle portion having a web generally orthogonal to the panel segment and a flange generally parallel to the panel segment and adjoining the web along a secondary bend, wherein the rail portion extends generally parallel to the web portion, and wherein one of the plurality of panels is fixed to the gunwale panel by a longitudinal weld seam joining the plate portion of the one panel to the primary bend of the gunwale panel.

11. The panel assembly according to claim 10, further comprising an elongated bilge radius panel roll-formed from a single strip of material, the bilge radius panel being roll-formed to include a plate portion and a rail portion adjoining the plate portion along a longitudinal bend, the plate portion having a generally flat panel segment, wherein the rail portion extends generally orthogonol to the panel segment, and wherein the bilge radius panel is fixed to another one of the plurality of panels by a longitudinal weld seam joining the plate portion of the bilge radius panel to the primary bend of the another panel.

12. The panel assembly according to claim 10, wherein the panel assembly includes a rake angle cut at an end of the panel assembly.

13. An elongated metal panel for use in constructing a marine vessel, the metal panel being roll-formed from a single strip of material having a predetermined thickness, the strip being roll-formed to include a plate portion and an angle portion adjoining the plate portion along a longitudinal primary bend, the plate portion having a generally flat panel segment, the angle portion having a flat web generally orthogonal to the panel segment and a flange generally parallel to the panel segment and adjoining the web along a secondary bend;

wherein the plate portion includes a side region extending parallel to the primary bend and arranged to engage at least one of the primary bend and the flat web of an identical panel sidewise adjacent thereto.

14. The panel according to claim 13, further comprising a roll-formed longitudinal tertiary bend along the plate portion.

15. The panel according to claim 14, wherein the side region consists of the tertiary bend.

16. The panel according to claim 14, wherein the side region adjoins the panel segment along the tertiary bend.

17. The panel according to claim 16, wherein the side region includes an inclined surface sloped relative to the panel segment.

18. The panel according to claim 16, wherein the side region includes a surface generally orthogonal to the panel segment.

19. The panel according to claim 13, wherein the side region includes a concave curved surface corresponding in curvature to an outer convex surface of the primary bend.

20. The panel according to claim 13, wherein the side region includes an inclined surface sloped relative to the panel segment.

21. A method of manufacturing a panel assembly for use in constructing a marine vessel, the method comprising the steps of:

A) roll-forming a plurality of elongated flat metal strips to make a plurality of elongated metal panels, wherein the roll-forming operation includes forming a longitudinal primary bend to distinguish a plate portion of the panel from an angle portion of the panel, and forming a longitudinal secondary bend to distinguish a flange of the angle portion from a web of the angle portion, the flange extending in an opposite direction from the web than the plate portion;

B) arranging the plurality of panels side-by-side such that the plate portion of one panel engages at least one of the primary bend and the web of a sidewise adjacent panel; and C) for each pair of sidewise adjacent panels provided in step (B), welding the plate portion of the one panel to the primary bend of the adjacent panel to form a respective longitudinal weld seam joining such pair of sidewise adjacent panels.

22. The method according to claim 21, wherein the roll-forming operation further includes forming a longitudinal tertiary bend along the plate portion of at least one of the plurality of panels.

23. The method according to claim 21, further comprising the step of machining a side region of at least one of the plurality of panels to provide a concave curved surface along the side region.

24. The method according to claim 21, further comprising the step of machining a side region of at least one of the plurality of panels to provide an inclined surface sloped relative to a panel segment of the plate portion.

* * * * *